United States Patent [19]

Shishido

[11] Patent Number: 4,911,477

[45] Date of Patent: Mar. 27, 1990

[54] RELEASABLE SELF-ADHESIVE LAMINATE

[76] Inventor: Shigenari Shishido, 1-50, Ohsawa-chome, Mitakaka-shi Tokyo, Japan

[21] Appl. No.: 192,270

[22] Filed: May 10, 1988

[51] Int. Cl.[4] ..... B42D 15/00

[52] U.S. Cl. ..... 283/100; 283/81; 283/112; 283/901; 283/904

[58] Field of Search ..... 283/81, 100, 112, 901, 283/904

[56] References Cited

U.S. PATENT DOCUMENTS

| | | | |
|---|---|---|---|
| 4,277,089 | 7/1981 | Lockhart | 283/81 X |
| 4,318,235 | 3/1982 | Augeri | 283/81 X |
| 4,379,573 | 4/1983 | Lomeli et al. | 283/81 X |
| 4,479,838 | 10/1984 | Dunsirn et al. | 283/81 X |
| 4,512,581 | 4/1985 | Levine | 283/100 X |
| 4,674,771 | 6/1987 | Thompson, II | 283/81 X |
| 4,742,954 | 5/1988 | Shishido | 283/100 |

FOREIGN PATENT DOCUMENTS

| | | |
|---|---|---|
| 55-36858 | 8/1980 | Japan . |
| 62-9279 | 1/1987 | Japan . |
| 62-9280 | 1/1987 | Japan . |
| 63-21068 | 2/1988 | Japan . |
| 63-21069 | 2/1988 | Japan . |

*Primary Examiner*—Paul A. Bell

*Attorney, Agent, or Firm*—James R. Longacre; Michael L. Keller

[57] ABSTRACT

A releasable self-adhesive film laminate designed for a sealed label or card comprises a pair of transparent films made of a thermoplastic EVA composition mainly comprising about 3 to 18% by weight of vinyl acetate and about 97 to 82% by weight of ethylene formed through a thermoforming process, for example, blow-molding and urging facing inner walls of the molded tubular film to each other, while hot, under pressure. A sealed label or card can be made easily and simply by using the releasable self-adhesive film laminate.

8 Claims, 3 Drawing Sheets

RELEASABLE SELF-ADHESIVE LAMINATE

BACKGROUND OF THE INVENTION

1. Field of the Invention

The present invention relates to a releasable self-adhesive film laminate for a label or card, as well as a label or card having such a releasable self-adhesive film laminate. Specifically, the present invention concerns a label or card in which the printed surface of a label substrate, etc., is usually concealed by a film laminate but it can be revealed as required.

Such a type of label or card is already known, as disclosed in, for example, Japanese Utility Model Publication No. Sho 55-36858 under the title of "Sealed Sticker". In this sticker, a transparent film is attached to a printed surface of a label paper by means of a strong pressure-sensitive adhesive layer, and a top label, i.e., a cover seal is bonded releasably to the upper surface of the transparent film by means of a weak adhesive layer.

If a user wishes to remove the cover seal, the cover seal can be peeled off the upper surface of the film, leaving the film on the label paper, owing to the difference in bonding strength between the strong and weak adhesive layers. The user can then enjoy the print revealed on the first label paper, through the transparent film.

Recently, demands have increased for practical sealed labels or cards, such as a lottery ticket with a prize number that is usually concealed, or a sealed postcard used as a substitute for a letter sealed in an envelope. Although various ideas for such goods have been proposed, most of them utilize pressure-sensitive adhesives as described above and, accordingly, involve the inconvenience that the stickiness of the adhesive remains to some extent after the seal cover is peeld off.

In addition, control of the difference in bonding strength between the adhesive layers on either side of the film is not easy. If the adhesion of the cover seal were too great, the film would be peeled off the label paper together with the cover seal, damaging the surface of the label paper. On the other hand, if the adhesion of the cover seal were insufficient, the cover seal could peel off easily during usual handling.

In view of the above, the present inventor, et al., proposed a postcard having a releasable bond surface between adjacent film layers in, for example, U.S. Pat. No. 4,742,954 (Japanese Utility Model Laid-Open Sho 63-6870). In our proposed postcard, a cover sheet (seal) is releasably attached to the surface of a card substrate by laminated film layers.

In this postcard, the laminated film layers comprise, as stated in the claim, a transparent protection film 2 made of a thermoplastic resin bonded by means of an adhesive layer 7 to the upper surface of a card substrate 1, a film 3 which is made of a thermoplastic resin different from that of the film 2 and which is firmly laminated onto the under surface of a cover sheet 4, and a coupling film layer 5 made of the same thermoplastic resin as that of the film 3. The film 5 is inserted in a melted state between the cover sheet 4 and the film 2, and is bonded firmly to the film 3 under the cover sheet 1 while being bonded releasably to the upper surface of the film 2.

The adhesion formed between the adjacent films 2 and 4 is unique in that its peeling strength can be freely varied by controlling the melting temperature of the film 5 and by selecting a suitable combination of materials for the two film layers 2 and 5, and in that none of the surfaces of the films 2 and 4 exhibits any stickiness after being peeled away from each other.

Such distinctive adhesion formed between different kinds of thermoplastic film layers is referred to as "pseudo adhesion", and it is currently utilized in practice to answer many requirements. We have also proposed several applications for this form of adhesion in, for example, Japanese Utility Model Laid-Open Nos. Sho 63-21068 and 63-21069.

The features of "pseudo adhesion" are practical and convenient. However, it still involves problems. The first problem is that the manufacture of the three-layer film structure with a "pseudo adhesion" boundary is troublesome and also expensive. Next, as is well-known, temperature control is one of the most delicate factors of plastic molding. Accordingly, accurate adjustment of the pseudo adhesion strength requires considerable skill. In addition, the optimal melting temperature for the target bonding strength varies with every combination of resin materials.

In view of the above, it is a first object of the present invention to provide a releasable self-adhesive film laminate comprising a pair of films, made of the same kind of thermoplastic resin and releasably joined to each other, that can be used as an element for a label or card equipped with a releasable seal.

It is a second object of the present invention to provide a label equipped with a releasable seal that can be manufactured easily and at a low cost.

It is a third object of the present invention to provide a card equipped with a releasable seal that can be manufactured easily at a low cost and also be convenient to use.

The first object of the present invention can be attained by a releasable self-adhesive film laminate designed for a sealed label or card having a pair of transparent films prepared by blow-molding a thermoplastic EVA composition comprising about 3 to 18% by weight of vinyl acetate and about 97 to 82% by weight of ethylene at a molding die temperature of about 120° to 210° C. to form a hollow tubular film body, and then urging facing wall surfaces of the molded tubular body, while hot, under pressure to laminate and releasably bond them to each other.

The second object of the present invention can be attained by a label equipped with a releasable seal, the label having:

a label substrate of which one surface is to have a printed or written massage, a cover seal attached releasably over the printed or written surface of the label substrate, and a releasable self-adhesive film laminate firmly sandwiched by means of transparent pressure-sensitive adhesive layers between the label substrate and the cover seal, to releasably bond the cover seal to the surface of the label substrate, wherein the releasable self-adhesive film laminate comprises a pair of transparent films, each made of a thermoplastic EVA composition comprising about 3 to 18% by weight of vinyl acetate and about 97 to 82% by weight of ethylene prepared by a thermoforming process and by being bonded to each other while hot under pressure.

The third object of the present invention can be attained by a card equipped with a releasable seal having:

a card substrate with one surface having a printed or written message which is intended to be concealed, a cover seal of a high hiding power attached releasably over the card substrate, and a releasable self-adhesive film laminate sandwiched by means of transparent pressure-sensitive adhesive layers between the card substrate and the cover seal, wherein the releasable self-adhesive film laminate comprises a pair of transparent films, each made of a thermoplastic EVA composition comprising about 3 to 18% by weight of vinyl acetate and about 97 to 82% by weight of ethylene prepared by a thermoforming process and by being bonded to each other, while hot, under pressure thereby forming a releasable boundary between the paired films.

The releasable boundary between the paired layers of the film laminates are slit at least one peripheral portion thereof and heat-sealing is further applied to the outer edge of the peripheral edge that was slit.

DETAILED DESCRIPTION OF THE INVENTION

A pair of transparent films made of a thermoplastic resin comprising an ethylene and vinyl acetate copolymer obtained from a thermoforming process are joined to each other under pressure while hot, so that they form a releasably adhered film laminate having a releasable boundary between the film layers. Such a film laminate can be prepared simply by blow-molding the ethylene-vinyl acetate copolymer (EVA composition) to form a hollow tubular body at a molding die temperature of 120° to 210° C., and subsequently urging facing inner wall surfaces of the tubular film toward each other.

The releasable boundary between the film layers exhibits a distinctive adhesion property in that the paired films do not separate easily during normal handling, but they can be peeled from each other smoothly by the application of a peeling force at an angle of 180° or 90° with a low strength of from a few g/cm (width) to about 50 g/cm (width), depending on the EVA composition. The surface of each film after peeling exhibits no stickiness at all and has not lost its transparency. It is an interesting and convenient fact that the adhesion strength between the films varies with the EVA composition which can easily be changed.

The peeling strength between the pair of films is increased if the proportion of vinyl acetate in the EVA composition is increased, and this proportion is preferably from 3 to 18% by weight based on the total composition. If the proportion of vinyl acetate is less than 3% by weight, no substantial effect is obtained by the addition of the vinyl acetate, and also a high molding temperature becomes necessary which is not favorable from the point of view of the production process. On the other hand, if the proportion of vinyl acetate exceeds 18% by weight, the blow-moldability of the composition becomes so instable, that, for example, a stable film can not be formed from the ring die used for the inflation molding.

The releasable self-adhesive film laminate according to the present invention can be used in various practical applications.

According to another feature of the present invention, the releasable self-adhesive film laminate described above can be applied to a label equipped with a releasable seal and comprising a label substrate, a cover seal attached releasably over the label substrate, and a releasable self-adhesive film laminate that bonds the cover seal releasably to the substrate.

Since the surface of the label substrate is usually concealed by the cover seal attached thereover, any message printed on the surface thereof can not be seen from the outside. Subsequently, since the film laminate is firmly bonded by means of pressure-sensitive adhesive layers between the label substrate and the cover seal, if a user wishes to peel off the cover seal, peeling always occurs at the releasable boundary between the pair of film layers so that the cover seal can be removed smoothly while leaving the upper and lower transparent films on the cover seal and label substrate, respectively.

The user can then see the printed message on the label substrate through the transparent lower film. This state is ensured by the distinct difference between the peeling strength at the boundary of the pair of films, which is from a few g/cm to about 50 g/cm, and the much greater peeling strength of the conventional pressure-sensitive adhesive between the lower film and the label substrate, which is at least ten times greater. Furthermore, since no stickiness remains on the surfaces of the films after the peeling, the user has no trouble handling the label.

The label substrate may be of conventional label paper and any desired lettering, symbols or pictures, etc., may be printed or written on its surface. The cover seal may be of conventioned label paper or any other material, so long as it can be firmly bonded to the surface of the EVA film laminate. If the laminate is relatively thick, an aluminum or paint coating may be applied onto the surface of the upper film as a substitute for the cover seal.

The most practical and interesting application of the releasable self-adhesive film laminate is a so-called postcard equipped with a releasable seal, as a substitute for a letter sealed in an envelope.

The basic feature of a card equipped with a releasable seal is similar to that of the label described above. However, the conditions encountered by the postcards, etc., in use are much more severe than those of labels. For instance, the sealed portion must never be revealed either accidentally or by surreptitious design until the card is delivered to the recipient, and this means that the paired transparent EVA films constituting the film laminate have to be bonded securely to each other. On the other hand, the pair of films must be able to peel apart easily, without damaging the printed substrate, when the recipient wishes to reveal the contents of the card.

The card with a releasable seal according to the present invention comprises a card substrate, a cover seal having a high hiding power attached over the card substrate, and a releasable self-adhesive film laminate that releasably bonds the cover seal over the card substrate. Since the film laminate sandwiched between the card substrate and the cover seal comprises a pair of transparent films that are releasably bonded to each other, printed or written information on the surface of the card substrate is usually hidden by the cover seal attached thereover.

Although the bonding strength between the pair of EVA films is much lower than that of conventional pressure-sensitive adhesives, they do not easily peel from each other during normal handling. However, to prevent accidental or surreptitious peeling, it is desirable that heat-sealing is applied along the peripheral edges of the film layers. In this case, the releasable boundary between the film layers is preferably slit at a portion inside the heat-sealed edge.

Since the pair of films are securely bonded to each other along the peripheral edges thereof, no one can surreptitiously open the seal without tearing the sealed edge. Once the recipient has removed the heat-sealed edge by, for example, cutting it with a knife, he can easily peel apart the mating pair of films at the slit portion between the films, along the portion thereof inside the heat-sealed periphery. A perforated line or tear line may be provided in this portion to allow access through the cover seal to the releasable boundary of the film laminate. When the recipient bends the card along the perforated line, the end surface of the laminate is revealed to facilitate the peeling apart of the pair of films.

Since the lower transparent EVA film remains secured by means of a transpare pressure-adhesive layer to the printed surface of the substrate card, information printed on the substrate card can be read easily. In addition, since the film surface exhibits no stickiness, the card can be stored together with other documents without any danger of adhering to other papers or collecting dust.

The card according to the present invention can be preferably embodied in, for example, the form of a reply postcard in which a card substrate of twice the normal area is made foldable at the center thereof, sandwiching a releasable self-adhesive film laminate therebetween. The film laminate is bonded to the facing surfaces of the foldable card substrate by means of a pressure-sensitive adhesive layer, etc.

In this case, the postcard is initially mailed to its recipient with its two halves folded over and secured to each other. The recipient opens the card at the releasable boundary in the film laminate and then cuts off and returns one-half of the card substrate as a conventional postcard.

Of course, this postcard can be used not only as a reply card, but also as a conventional card containing twice as much information than usual, while keeping its contents secret.

A simple way of manufacturing the above-described reply postcard is to sandwich a film laminate between separate upper and lower card substrates by means of pressure-sensitive adhesive layers and applying heat-sealing on one side edge of the film laminate, such as a longitudinal side. Of course, auxiliary heat-sealing may also be applied to other peripheral edges.

The heat-sealed edge formed along one longitudinal side functions as a hinge when the card is unfolded into individual card substrates. A card of this form can be manufactured by merely using a simple laminator.

BRIEF DESCRIPTION OF THE ACCOMPANYING DRAWINGS

DESCRIPTION OF PREFERRED EMBODIMENTS

Figure 1:
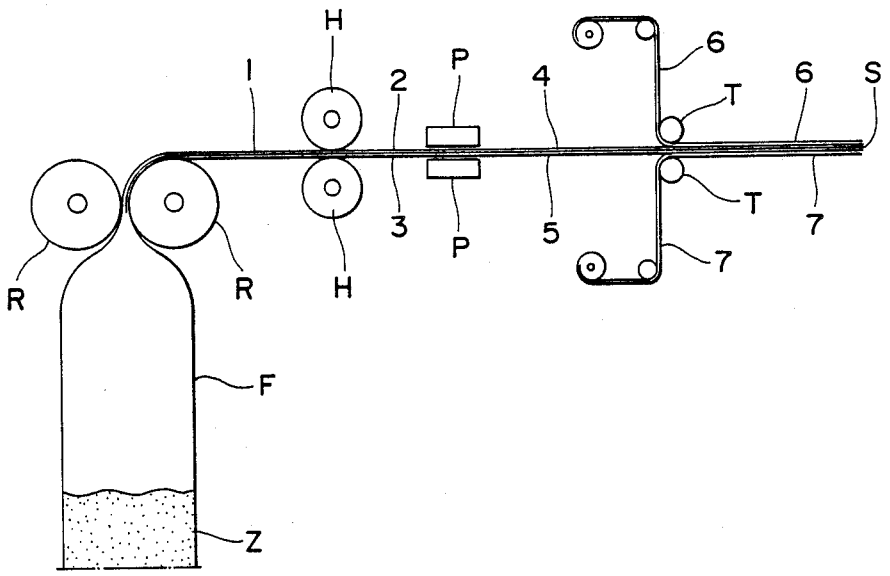
FIG. 1 is an explanatory view of the manufacture of a self-releasable film laminate according to the present invention by a blow-molding process.

FIG. 1 is an explanatory view in which a releasable self-adhesive film laminate according to the present invention is manufactured by a blow-molding process.

In FIG. 1, an EVA copolymer powder (trade name: EF1010, manufactured by Asahi Kasei Co.), having a melt index of 1.0 g/10 min. and containing about 90% by weight of ethylene and 10% by weight of vinyl acetate, is melted by heating in a screw cylinder of 40-cm diameter in a blow-molding machine (not illustrated) at a temperature of about 130° C., and is then blow-molded from a ring die to form a hollow tubular body F with a 50-um film thickness.

The thus-formed cylindrical tubular product is urged while hot between a pair of press rollers above a cooling zone Z, by which facing surfaces of the cylindrical film are integrated with each other, and it is then allowed to cool.

As shown in FIG. 1, the releasable self-adhesive film laminate 1 thus obtained is heat-sealed along both longitudinal edges thereof between a pair of heat-seal rollers H. If required, both edges of the film laminate 1 may previously be slit along a releasable boundary S formed between films 2 and 3 at a portion inside the heat-sealed edge by using a slitter, etc., to form a peel-starting region between the films. The film laminate 1 is then passed through a coating machine P that applies pressure-sensitive transparent adhesive layers 4 and 5 onto either surface thereof, and is then further passed between rollers T that attach silicon release paper sheets 6 and 7 on either side of the film laminate 1. In this film laminate 1, the transparent film layers 2 and 3 are releasably bonded to each other along the releasable boundary S, and can be peeled from each other with a peeling strength of about 20 g/cm (width) (180° peeling).

Figure 2:
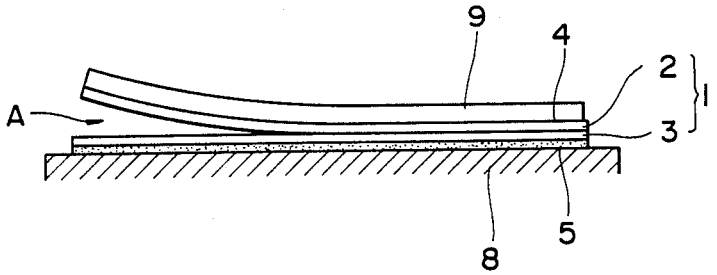
FIG. 2 is an explanatory cross-sectional view of one embodiment of a label equipped with a releasable seal according to the present invention, in a state where the seal of the label is about to be peeled off the label paper.

The film laminate 1 shown in FIG. 1 can be used as an element for a label equipped with a releasable seal, as shown in FIG. 2.

In this embodiment, a releasable film laminate comprising the transparent EVA film layers 2 and 3 described above is bonded by means of the transparent pressure-sensitive adhesive layer 5 to the printed surface of a label paper 8. Another label paper 9 is secured over the upper film 2 by means of the pressure-sensitive adhesive layer 4. Although not illustrated in FIG. 2, the releasable boundary S (FIG. 1) between the two film layers 2, 3 is slit, and peripheral heat-sealing is applied to the outer edge thereof.

Since a printed surface of the label paper 8 is usually sealed by the top label paper 9, any printed matter thereon is hidden and protected when the card is in its usual state.

When a user wishes to reveal the printed surface, the heat-sealed edge is first removed, e.g., by cutting, to expose the end surface of the laminate where the film layers 2, 3 have already been separated by slitting. Then the film laminate 1 is peeled off, starting at a portion A, and the peeling propagates over the entire surface.

In this case, since the peeling strength between the films 2 and 3 is about 20 g/cm, as described above, which is 1/10 or less than the bonding strength of the conventional pressure-sensitive adhesive layer 5, the lower film 3 is never peeled from the label paper 8 but peeling always occurs at the boundary S between the film layers 2 and 3. Thus the top label paper 9 can be smoothly peeled off from the substrate 8, leaving the lower transparent film layer 3 thereon.

A pressure-sensitive (or heat-sensitive) color developing layer 10 may be applied to the surface of the label paper 8. As the color developing layer 10, for example, a microcapsule type of self-color developing agent well-known in the art may be used. In this case, the label user can print any desired lettering or symbols from above the label paper 9, through the film laminate 1 to the heat-sensitive (or pressure-sensitive) layer 10 on the label substrate paper 8 by using a thermal printer (or dot printer) as required.

Figure 3:
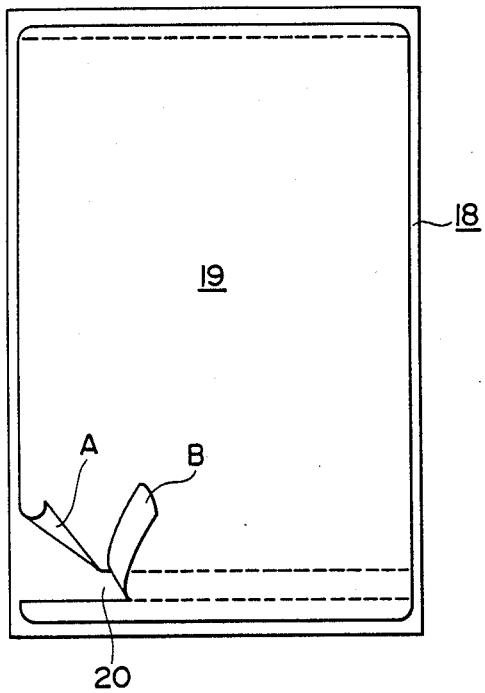
FIG. 3 is an explanatory view of one embodiment of a card equipped with a releasable seal according to the present invention.
Figure 4:
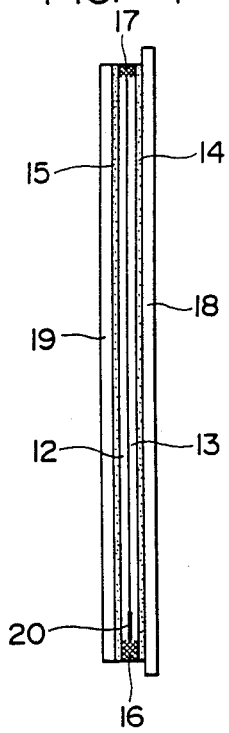
FIG. 4 is a explanatory cross-sectional view of the card shown in FIG. 3.

FIG. 3 and FIG. 4 show another embodiment of the present invention in the form of a postcard equipped with a releasable seal. In the figures, a releasable self-adhesive film laminate comprising a pair of transparent EVA film layers 12 and 13, similar to those described above, is sandwiched between a card substrate 18 and a cover seal 19 and secured by means of pressure-adhesive layers 14 and 15. In this case, the releasable boundary surface S (see FIG. 1) between the film layers 12 and 13 is slit along one side edge, that is, along a lower peripheral edge 20 thereof, to a predetermined width. Then heat-sealing is applied to the edge outer to the slit portion 20 at, for example, edge 16 (and also at edge 17 if necessary).

In this embodiment, private information that has to be kept secret, such as the balance of a bank deposit, is printed on the surface of the card substrate 18, and that information is concealed by means of the cover seal 19 having a high hiding power.

In order to provide the cover seal with such hiding power, it is desirable to apply, for example, an aluminum vapor deposition layer onto the rear surface thereof. Since the card substrate 18 and the cover seal 19 are bonded by means of pressure-adhesive layers 14 and 15 to the releasable self-adhesive film laminate sandwiched therebetween, the cover seal 19 can not easily be detached from the card substrate 18.

Two parallel perforated lines or tear lines are formed along the slit portion 20 through the cover seal 19 and the film layer 12 (illustrated by dashed lines in the lower portion of FIG. 3).

Since the heat-sealed edges 16 and 17 are formed on the upper and lower peripheral edges of the film laminate, peeling can never occur unless at least one of the heat-sealed edges is removed.

When the recipient wishes to read the contents of the card surface, he first picks up a tab B formed in the cover seal 19 and pulls it along the perforated lines. Since a slitting treatment has been used to slit the layers 12 and 13 along the strip-like portion 20 defined between the parallel perforated line, the strip, including part of the cover seal 19 and the upper film layer 12, can easily be removed to the right of the card, leaving the film layer 13.

Since this reveals the end surface of the laminate (12, 15, 19) along the upper perforated line, the cover seal 19 can easily be peeled off, starting from a portion A. Then the cover seal 19 can be completely detached along the releasable boundary between the film layers 12 and 13, leaving the lower transparent film 13 on the surface of the printed cared substrate 18 and making it possible to read the printed information. Since the surface of the film 13 exhibits no stickiness after the peeling, the card can be handled with ease.

Figure 5:
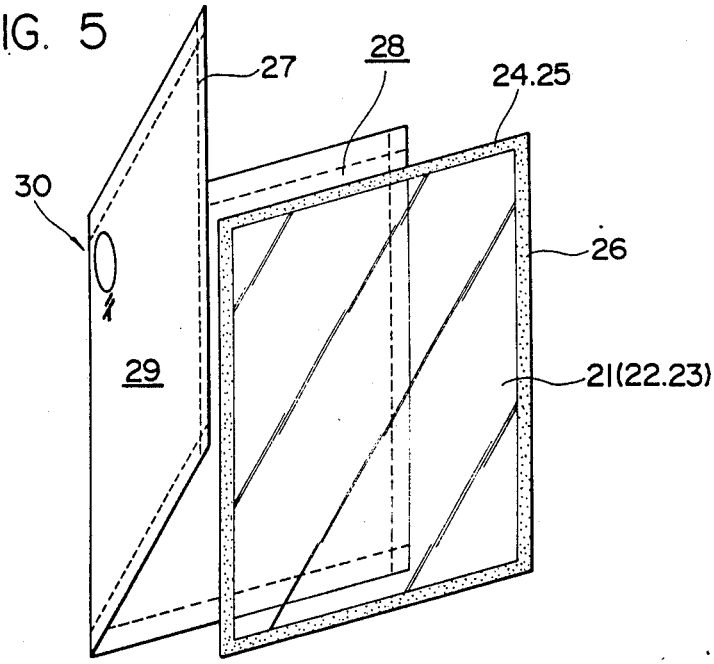
FIG. 5 is an explanatory view of another embodiment of the card equipped with a releasable seal according to the present invention, in which a releasable self-adhesive film laminate is sandwiched between halves of a reply postcard.

FIG. 5 shows another embodiment of the postcard equipped with a releasable seal according to the present invention. In this embodiment, a releasable self-adhesive film laminate 21 comprising a pair of transparent films 22 and 23, as described previously, is sandwiched by means of pressure-sensitive adhesive layers 24 and 25 between a foldable card 30 comprising a pair of card substrates 28 and 29 in the form of a reply postcard.

Figure 6:
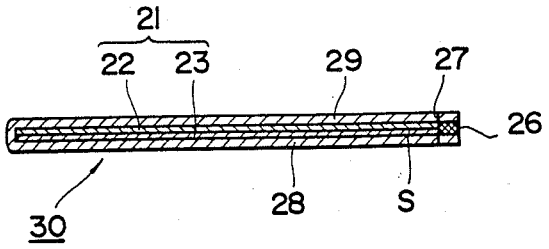
FIG. 6 is an explanatory cross-sectional view of the completed form of the postcard shown in FIG. 5.

As also shown in FIG. 6, the film layer 22 and 23 are heat-sealed together along a longitudinal edge 26 thereof. The heat-sealing may, alternatively, be applied along upper and lower edges thereof. Corresponding to the inside of the heat-sealed edges, a performated line 27 is cut through the card substrate 29 and the film laminate to enable opening the postcard.

The postcard is usually handled as a single card since the paired card substrates 28 and 29 are bonded together by the film laminate 21. The recipient can unfold the substrate cards 29 and 28 by cutting the card along the perforated line 27 to remove the heat-sealed edge 26, then peeling apart the film layers 22, 23 starting from the perforated line (or by utilizing a peeling strip similar to the strip 20 in FIG. 3).

Figure 7:
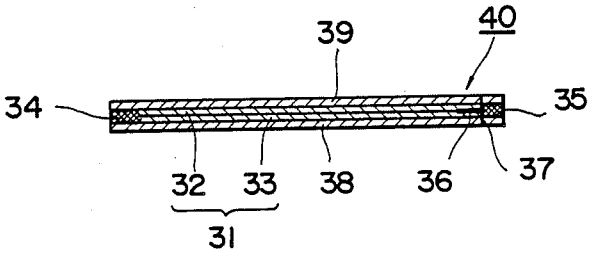
FIG. 7 is an explanatory cross-sectional view of a still further embodiment of the reply postcard according to the present invention.
Figure 8:
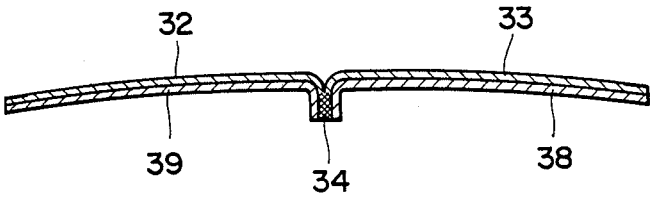
FIG. 8 is an explanatory view of the card shown in FIG. 7 in which the two card substrates are unfolded while remaining joined along a heat-sealed edge acting as a hinge.

FIG. 7 shows another embodiment of the reply postcard of the present invention. The postcard shown in FIG. 7 is substantially the same as that shown in FIG. 6, except that the one foldable card 30 comprising a pair of joined halves 28 and 29 in FIG. 6 is replaced with two separate upper and lower card substrates 38 and 39.

A releasable self-adhesive film laminate 31 comprising a pair of film layers 32 and 33 is sandwiched between the substrates 38 adn 39, and main heat-sealing is applied along one longitudinal edge 34 of the film laminate 31. Auxiliary heat-sealing may be applied along the opposite edge 35 to prevent accidental or surreptitious unfolding. In FIG. 7, 36 represents a slit portion to enable the start of peeling and 37 denotes a perforated line.

In this embodiment, the card substrates 38 and 39 are unfolded from each other in the same manner as in the embodiment of FIG. 6 after the heat-sealed edge 35 is removed along the perforated line 37 and peeling is started from the portion 36. In this case, although the card comprises separate substrates 38 and 39, the left edges of the card are joined to each other by means of the heat-sealed edge 34 that functions as a hinge when the card substrates are opened.

As can be seen from FIG. 7, the embodiment can be manufactured by merely laminating the card substrates 38 and 39 onto the releasable self-adhesive film laminate 31. This process requires neither troublesome manual working nor a complicated folding machine for preparing a reply postcard.

What is claimed is:

1. A releasable self-adhesive film laminate designed for a sealed label or card having a pair of transparent films prepared by blow-molding a thermoplastic EVA composition comprising about 3 to 18% by weight of vinyl acetate and about 97 to 82% by weight of ethylene at a molding die temperatures of about 120° to 210° C. to form a hollow tubular film body, and then urging facing wall surfaces of the molded tubular body, while hot, under pressure to laminate and releasably bond them to each other.

2. A film laminate as defined in claim 1, wherein releasing paper is appended by way of a pressure sensitive adhesive layer to at least one side of said film laminate.

3. A label equipped with a releasable seal, the label having:

a label substrate of which one surface is to have a printed or written message, a cover seal attached releasably over the printed or written surface of the label substrate, and a releasable self-adhesive film laminate firmly sandwiched by means of transparent pressure-sensitive adhesive layers between the label substrate and the cover seal, to releasably bond the cover seal to the surface of the label substrate, wherein the releasable self-adhesive film laminate comprises a pair of transparent films, each made of a thermoplastic EVA composition comprising about 3 to 18% by weight of vinyl acetate and about 97 to 82% by weight of ethylene prepared by a thermoforming process and by being bonded to each other while hot under pressure.

4. A label as defined in claim 3, wherein the surface of the label substrate bonded to the film laminate is applied with a pressure-sensitive color developing layer.

5. A label as defined in claim 3, wherein the surface of the label substrate bonded to the film laminate is applied with a heat-sensitive color developing layer.

6. A card equipped with a releasable seal having:

a card substrate with one surface having a printed or written message which is intended to be concealed, a cover seal of a high hiding power attached releasably over the card substrate, and a releasable self-adhesive film laminate sandwiched by means of transparent pressure-sensitive adhesive layers between the card substrate and the cover seal, wherein the releasable self-adhesive film laminate comprises a pair of transparent films, each made of a thermoplastic EVA composition comprising about 3 to 18% by weight of vinyl acetate and about 97 to 82% by weight of ethylene prepared by a thermoforming process and by being bonded to each other, while hot, under pressure thereby forming a releasable boundary between the paired films.

7. A card as defined in claim 14, wherein the pair of films of the film laminate are sandwiched between a pair of card substrates each one constituting a cover seal for another, joined foldably with each other and in which each outer surface of the pair of films is secure to each of the folded card substrates and said film laminate is fused securely by heat-sealing applied along at least one edge thereof.

8. A card as defined in claim 6, wherein the cover seal is constituted as another separate card substrate, and pair of films of the film laminate sandwiched between paired substrates are heat-sealed along one edge thereof so that said laminated card substrates can be unfolded into each of the card substrates while remaining joined along said heat-sealed edge as a hinge.

* * * * *